US006843015B2

(12) United States Patent
Sharp

(10) Patent No.: US 6,843,015 B2
(45) Date of Patent: Jan. 18, 2005

(54) BIPOD FOR FIREARMS

(76) Inventor: Ronnie L. Sharp, 504 Maple St., Nampa, ID (US) 83686

( * ) Notice: Subject to any disclaimer, the term of this patent is extended or adjusted under 35 U.S.C. 154(b) by 0 days.

(21) Appl. No.: 10/437,775

(22) Filed: May 13, 2003

(65) Prior Publication Data

US 2003/0192223 A1 Oct. 16, 2003

Related U.S. Application Data

(63) Continuation-in-part of application No. 10/012,784, filed on Nov. 5, 2001, now Pat. No. 6,560,911, which is a continuation-in-part of application No. 09/414,827, filed on Oct. 6, 1999, now abandoned.

(51) Int. Cl.[7] ..... F41C 27/00

(52) U.S. Cl. ..... 42/94; 211/64; 211/69.3; 211/69.5; 211/69.6; 211/70; 211/85; 211/203; 248/168; 248/439

(58) Field of Search ..... 42/94; 211/64, 211/14, 47, 66, 89.5, 203, 69.3, 69.5, 69.6, 70, 85; 248/168, 439

(56) References Cited

U.S. PATENT DOCUMENTS

| | | | | | |
|---|---|---|---|---|---|
| 1,431,058 | A | * | 10/1922 | Sutter | 42/94 |
| 1,812,967 | A | * | 7/1931 | Long | 248/168 |
| 2,420,267 | A | * | 5/1947 | Sefried, II | 42/94 |
| 2,436,349 | A | * | 2/1948 | Adams | 42/94 |
| 2,462,091 | A | | 2/1949 | Garand | 42/72 |
| 2,489,283 | A | * | 11/1949 | Garand | 42/94 |
| 2,775,052 | A | * | 12/1956 | Musser et al. | 42/94 |
| 2,807,904 | A | * | 10/1957 | Kreske | 42/94 |
| 2,984,444 | A | * | 5/1961 | Lewis | 248/166 |
| 3,256,632 | A | | 6/1966 | Beretta | 42/72 |
| 3,570,162 | A | | 3/1971 | Suddarth | 42/72 |
| 3,618,249 | A | | 11/1971 | Grandy | 42/73 |
| 3,999,461 | A | * | 12/1976 | Johnson et al. | 89/191.01 |
| 4,017,997 | A | * | 4/1977 | Peterson et al. | 42/94 |
| 4,135,691 | A | * | 1/1979 | Wiesmann | 248/188.6 |
| 4,191,111 | A | * | 3/1980 | Emmert | 108/132 |
| 4,265,045 | A | * | 5/1981 | Garbini | 42/94 |
| 4,266,748 | A | * | 5/1981 | Dalton | 248/425 |
| 4,327,626 | A | | 5/1982 | McQueen | 89/197 |
| 4,351,224 | A | * | 9/1982 | Curtis | 89/37.04 |
| 4,430,822 | A | | 2/1984 | Fromming et al. | 42/71 |
| 4,438,896 | A | * | 3/1984 | Hall | 248/523 |
| 4,513,523 | A | | 4/1985 | Gal | 42/72 |
| 4,560,134 | A | * | 12/1985 | Klein | 248/511 |
| 4,580,483 | A | * | 4/1986 | Garbini | 89/40.06 |
| 4,607,561 | A | * | 8/1986 | Frimer | 89/37.04 |
| 4,625,620 | A | * | 12/1986 | Harris | 89/37.04 |
| 4,641,451 | A | * | 2/1987 | Harris | 42/85 |
| 4,776,124 | A | * | 10/1988 | Clifton | 42/94 |

(List continued on next page.)

FOREIGN PATENT DOCUMENTS

| | | | |
|---|---|---|---|
| DE | 637421 | * | 3/1935 |
| EP | 0071887 | * | 2/1983 |
| GB | 2090951 | * | 12/1981 |

*Primary Examiner*—Michael J. Carone
*Assistant Examiner*—John Richardson
(74) *Attorney, Agent, or Firm*—Pedersen & Co., PLLC; Ken J. Pedersen; Barbara S. Pedersen

(57) ABSTRACT

A bipod for a firearm, or other equipment utilizing a multiple-leg pod, is provided that features easy, snap-apart and snap-together legs and snap-on and snap-off connection of the bipod to a ball or knob on the firearm or other equipment. The legs are preferably received in bores/holes in the bipod body and, during snapping in and out, the legs move past protrusions that restrict movement of the legs between different lobes of the bores/holes. The ball joint formed between the ball/knob and the main body of the bipod serves as preferably the only connection that moves during use by the shooter. As the shooter swivels, tilts, or pans the gun, the ball/knob attached to the firearm moves in the top socket of the main body of the bipod, with the legs being stationary relative to the main body.

15 Claims, 10 Drawing Sheets

U.S. PATENT DOCUMENTS 4,878,305 A 11/1989 Gabrielidis ..... 42/72
5,029,407 A * 7/1991 Kirkpatrick ..... 42/94
5,194,678 A * 3/1993 Kramer ..... 42/94
5,305,539 A 4/1994 Von Kuster ..... 42/75.01
5,367,812 A 11/1994 Lautrec ..... 42/74
5,404,962 A * 4/1995 Carter ..... 182/153
5,505,415 A * 4/1996 Brett ..... 248/168
5,542,639 A * 8/1996 Wixey et al. ..... 248/439
5,711,102 A 1/1998 Plaster et al. ..... 42/71.01
5,711,103 A * 1/1998 Keng ..... 42/94
5,815,974 A * 10/1998 Keng ..... 42/94
5,913,668 A * 6/1999 Messer ..... 42/94
5,937,560 A * 8/1999 Beltz ..... 42/94
6,007,032 A * 12/1999 Kuo ..... 248/185.1
6,027,133 A * 2/2000 Phillips ..... 280/293
6,213,525 B1 * 4/2001 Nicola ..... 292/223
6,289,622 B1 * 9/2001 Desch et al. ..... 42/94
6,487,807 B1 * 12/2002 Kopman et al. ..... 42/94
6,601,805 B1 * 8/2003 Kapp ..... 248/171
6,663,071 B2 * 12/2003 Peterson ..... 248/440.1
6,688,566 B1 * 2/2004 Crain et al. ..... 248/168

* cited by examiner

Top View

Internal View
of One Half

Bottom
View

FIG.15A TOP VIEW

BIPOD FOR FIREARMS

This application claims priority and is a continuation-in-part of U.S. patent application entitled "ADJUSTABLE GUN STOCK" Ser. No. 10/012,784, filed Nov. 5, 2001, and issuing on May 13, 2003 as U.S. Pat. No. 6,560,911, which is a continuation-in-part of U.S. patent application entitled "ADJUSTABLE GUN STOCK" Ser. No. 09/414,827, filed on Oct. 6, 1999, abandoned, which application is incorporated herein by this reference.

BACKGROUND OF THE INVENTION

1. Field of the Invention

The present invention generally relates to systems for supporting and/or stabilizing a gun for a shooter or other user of firearms. More particularly, the invention relates to systems that include a bipod for supporting the front of a gun and/or an adjustable gun stock. The bipod is easily attached to the gun and set-up and, in use, provides a great range of movement of the gun relative to the bi-pod, including tilting of the gun forward or backward, as well as panning side to side.

2. Related Art

Since the advent of shoulder-fired weaponry, such as guns, the use of a stock for holding the barrel and firing mechanisms of the weapon has been a standard practice. Typically, a stock made of wood, plastic, or metal extends rearward from the firing mechanism a certain distance, creating what is often referred to as a "gun butt" portion. This gun butt portion is used to stabilize the weapon by the user pressing the gun butt against his/her shoulder while aiming and firing the weapon.

Standard rifles and other shoulder-fired weapons customarily have stocks with a butt portion located a particular distance from the trigger, often referred to as a pull length. The pull length distance for the standard rifle is based on the arm length of an "average user." A difficulty arises when a user of size smaller than the hypothetical "average user" attempts to use such a weapon. The difficulty is due to the fact that for these smaller individuals, the butt portion of the stock, which is held against the front of the user's shoulder, is too far from the trigger for the user to comfortably reach the trigger and/or properly and safely operate the weapon. Therefore, there is a need for a finely-adjustable gun stock that preferably is continuously adjustable between the extremes of its fully-extended and fully-retracted positions. There is also a need for an adjustable gun stock that is very stable on the user's shoulder and that is unlikely to twist or pivot off of the user's shoulder.

There is a further need for support and stabilization of the front of a gun, whether or not the gun includes an adjustable gun stock. While many pod units have been designed for firearms, there is still a need for a bipod that is easy to install on the gun and to set-up, and which provides a wide range of movement that are optimum for aiming and using a gun, and also for hands-on learning of gun skills and safety rules.

SUMMARY OF THE INVENTION

The invention comprises a pod support for the front of a firearm, which includes a system for convenient set-up of the legs on the ground or other surface and preferably a system for convenient connection to, and disconnection from, the gun. The preferred pod support is a bipod of adjustable height that includes legs that snap-apart and snap-together in a bipod main body. The preferred pod support also includes an adaptor that easily connects to the gun by attaching to a standard sling swivel stud and which connects to the pod main body by means of a ball-type joint. Thus, with the legs stationary relative to the ground and to the main body and the adaptor stationary relative to the gun, moving of the gun, including tilting and panning in a three dimensional space is accomplished by means of the adaptor moving relative to the main body. The preferred adaptor, therefore, allows the gun to move relative to the stationary bipod legs without any movement of the legs relative to the main body of the bipod.

The invented pod support may be used on a wide variety of firearms, including conventional firearms and/or those that have a gun stock adapted according to embodiments of the invented adjustable gun stock invention. The combination of the convenient invented bipod and an adjustable-length firearm stock allows an adult, instructing an adolescent in the proper firing of a weapon, to properly position the firearm so that the adolescent may fire it and both adult and adolescent may be more sure of a safe firearm operation.

Still other objects and advantages of the present invention will become readily apparent to those skilled in this art from the following detailed description wherein I have shown and described only preferred embodiments of the invention, simply by way of illustration of the best mode contemplated by carrying out my invention. As will be realized, the invention is capable of modification in various respects without departing from the invention.

BRIEF DESCRIPTION OF THE DRAWINGS

FIG. 15A is a top view of one embodiment of an adaptor that may be used to connect embodiments of the invented bipod to a conventional swivel.

DESCRIPTION OF THE PREFERRED EMBODIMENTS

Figure 1:
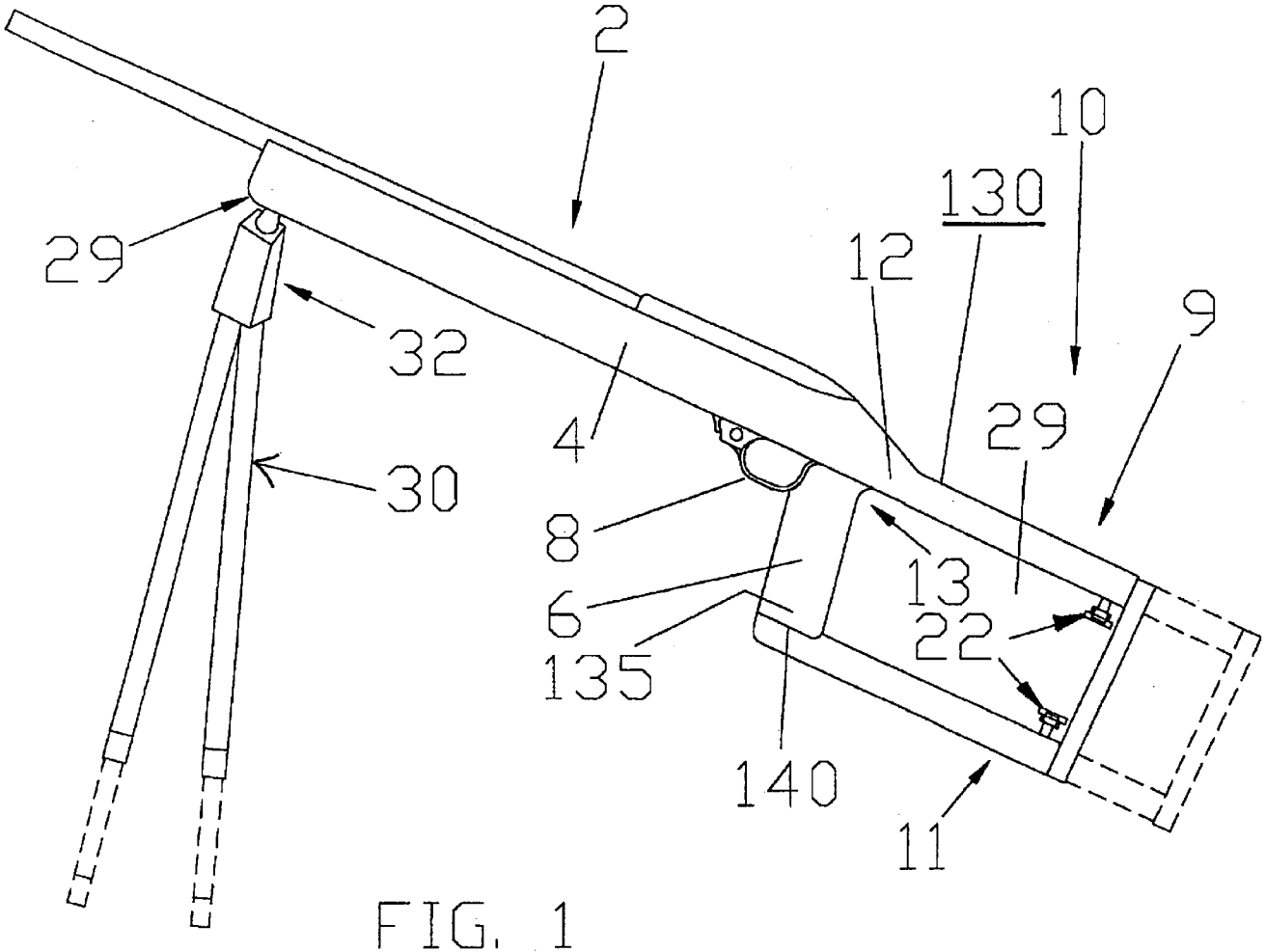
FIG. 1 is a perspective view of the one embodiment of the present bipod invention, in use on a weapon with the extendible shoulder piece.

Referring to the Figures, there are shown several, but not the only, embodiments of the invented pod support and embodiments of the adjustable gun stock that may optionally be used on a gun being supported by the invented pod support. Further, the invention may comprise a method of using the invented pod support and an extendible shoulder piece within a shooting system for use by adolescents. The preferred embodiment of the adjustable gun stock is described first in the text below, followed by a description of preferred embodiments of the invented pod support. As used herein, "weapon" is intended to include all human-held weaponry including, but not limited to: military weaponry, rifles, shotguns, pellet guns, "BB" guns, firearms, paint guns, and crossbows. Typically, but not necessarily, the weapons used with the invented pod support are shoulder-fired, so that the front/barrel of the gun is supported by the invented pod support and the rear/butt of the gun is supported by the user's shoulder.

Adjustable Gun Stock

An extendible shoulder piece for a weapon may be provided as a system for stabilizing and supporting the rear of the weapon against the user's shoulder, but, due to its adjustability, by means that allow very precise adjustment of the length of the stock depending upon the physical features and size of the user.

The preferred embodiment of the extendible shoulder piece is added to the rearward end of a gun stock that is rearwardly-shortened. The weapon's "shortened stock" is shortened relative to the conventional "average" gun stock, either by removal of a rear portion of the conventional gun stock, or by fabrication of the gun stock during original manufacture to purposely be short. Alternatively, one may see that the extendible shoulder piece may also be molded, carved, or otherwise formed as an integral part of the gun stock, in the general location of, and replacing, a conventional gun butt. The preferred extendible shoulder piece is connected to the shortened gun stock just behind the grip portion of the stock, which is gripped by the user during shooting and which is adjacent to the weapon's trigger guard.

The preferred shoulder piece has a butt plate, at its rearmost end, that has a generally vertical rear surface for abutting against the user's shoulder. The butt plate is adjustably connected to the shortened gun stock, preferably by means of a telescoping connection that can be securely locked and easily unlocked for adjusting the shoulder piece to fit various users. Preferably, the adjustable connection comprises an upper connector that extends longitudinally rearward from the shortened gun stock slightly below the longitudinal axis of the barrel and slightly below the sights of the gun. Preferably, the adjustable connection also comprises a lower connector that extends longitudinally rearward from the bottom end of the grip portion of the gun stock, so that the lower connector is distanced a maximum amount from the upper connector, to maximize the height of the extendible shoulder piece to stabilize the butt plate on the shoulder and to stabilize the butt plate relative to the connectors and the gun stock. By providing the maximally-spaced upper and lower connectors with a long butt plate (measured vertically between the top edge and the bottom edge of the butt plate) and by attaching the upper and lower connectors near the top edge and bottom edge of the butt plate, respectively, the forces exerted on the butt plate during use are less prone to pivot or leverage the butt plate off of the shoulder and less prone to damage or wear the preferred shoulder piece and its connection to the gun stock by that same pivoting/leverage.

In some embodiments, maximizing the distance between the upper and lower connectors is also important for maximizing the open space between the upper connector and the lower connector that provides room for the user's hand. This way, the user's hand may extend into the open space for operating lock or latch mechanisms to adjust the shoulder piece, or, in some embodiments, may rest in part of the open space as part of the gripping action during shooting. In the preferred embodiment of the adjustable gun stock, the upper connector is a telescoping first tube system, and the lower connector is a telescoping second tube system. The first tube system extends rearward from the upper region of the grip portion of the gun stock, and the second tube system extends rearward from the lower extremity, that is, the lowermost end, of the lower region of the grip portion. In some embodiments, wherein the lower region of the grip portion is a hand-hold member that extends downward in a definite pistol-grip style (see FIG. 1), both the thumb and fingers would curl around the hand-hold member, and the thumb and part of the hand extends into the open space between the first tube system and the second tube system. In other embodiments of gun stocks, the grip portion curves downward and rearward in a more gradual and subtle manner that is called herein a non-pistol-style grip (See FIGS. 5A–8B), creating a different look and feel from the pistol grip. In the non-pistol-grip style, the user's thumb curls around the upper region of that grip portion, the user's fingers curls around the lower region, and no part of the user's hand needs to extend into the open space between the first tube system and second tube system. In the non-pistol-style grip, the first and second tube systems tend to be closer together than in the pistol-style grip. This is because the upper region (to which the first tube system is attached) and the lowermost extremity of the grip (to which the second tube system is attached) are not as far apart as in the pistol-style grip embodiments, and, also, there is no need for the hand to extend into the open space between the tube systems. Therefore, to increase the total height (vertical dimension) of the butt plate, the butt plate preferably extends down below the second tube system to increase butt plate length and total area of the rear surface of the butt plate.

Therefore, an objection of the preferred extendible shoulder piece is to provide a more stable and reliable extendible gun stock that in prior art attempts at extending gun stocks. One way the preferred adjustable gun stock accomplishes this is to adapt the shoulder piece for attachment to the short gun stock so that the upper connector is positioned to be below the barrel longitudinal axis of the weapon for being a cheek rest for a user. Further, the hand-hold member lower extremity and the lower connector extending rearward from the hand-hold member lower extremity are preferably positioned to be a lowermost extremity of the weapon, that is, the structure of the weapon that extends the farthest downward when the weapon is in the generally horizontal position as shown, for example, in FIG. 5A. In embodiments that include a butt plate that extends below the lower connector, the lower extremity of the hand-hold member and the lower connector extending rearward from the hand-hold member lower extremity are preferably the lowermost extremity of the weapon forward from the butt plate, that is, the lowermost extremity of the weapon except for the butt plate and any bipod or tripod.

Each telescoping tube system may comprise a support rod member sliding into a support tube member, and a lock for securing preferably each tube system. For example, the lock may comprise a thumb screw/set screw extending through an orifice in the support tube member to tighten down against the support rod member. The locks prevents collapse or extension of the tubes and rods in relation to each other as the weapon fires.

The extendible shoulder piece adapts a gun stock to be adjustable to use by younger or smaller shooters and/or average-size users. Also, larger-than-average-size individuals may use the extendible shoulder piece, because they wish to have an adjustable gun stock that allows them to extend the length of the weapon farther from their shoulder.

Figure 7:
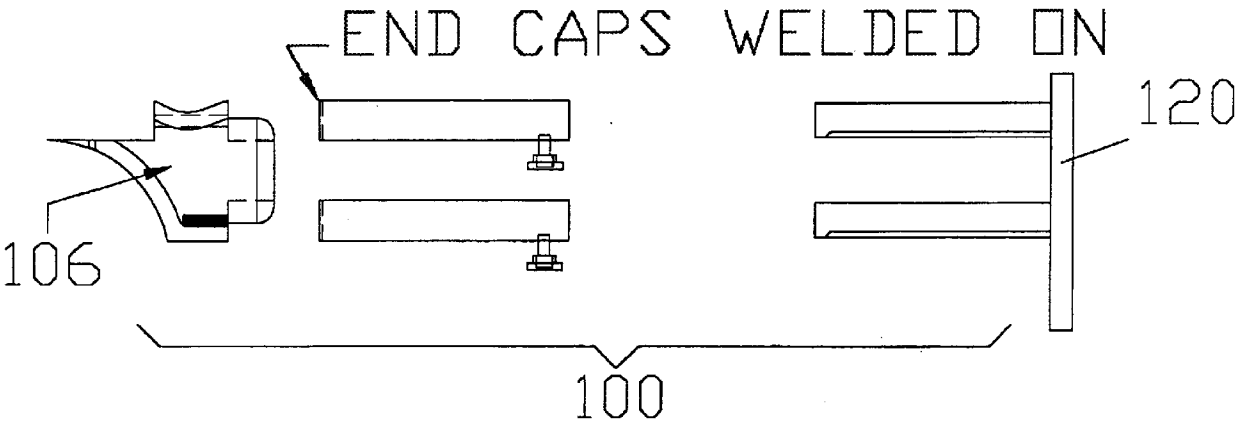
FIG. 7 is an exploded side view of the pieces-parts of the extendible shoulder piece of FIGS. 5A, 5B and 6, wherein the extendible shoulder piece is detached from the weapon.
Figure 8B:
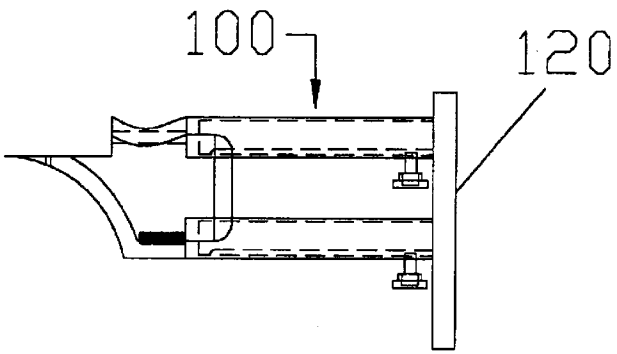
FIGS. 8A and 8B are side views of the extendible shoulder piece of FIGS. 5–7, shown in extended and retracted position, respectively.
Figure 8A:
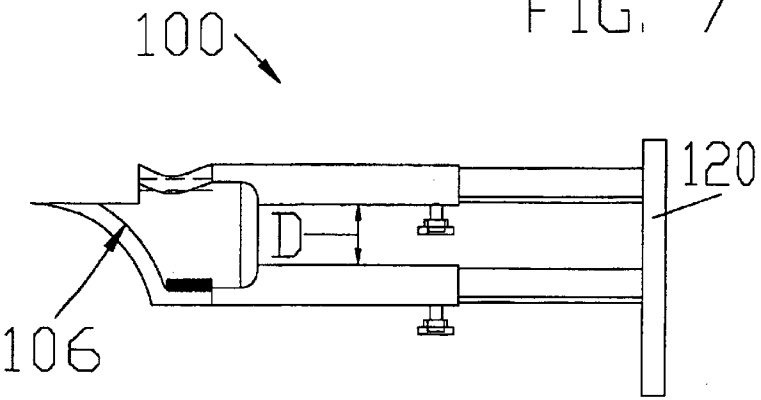
Figure 8C:
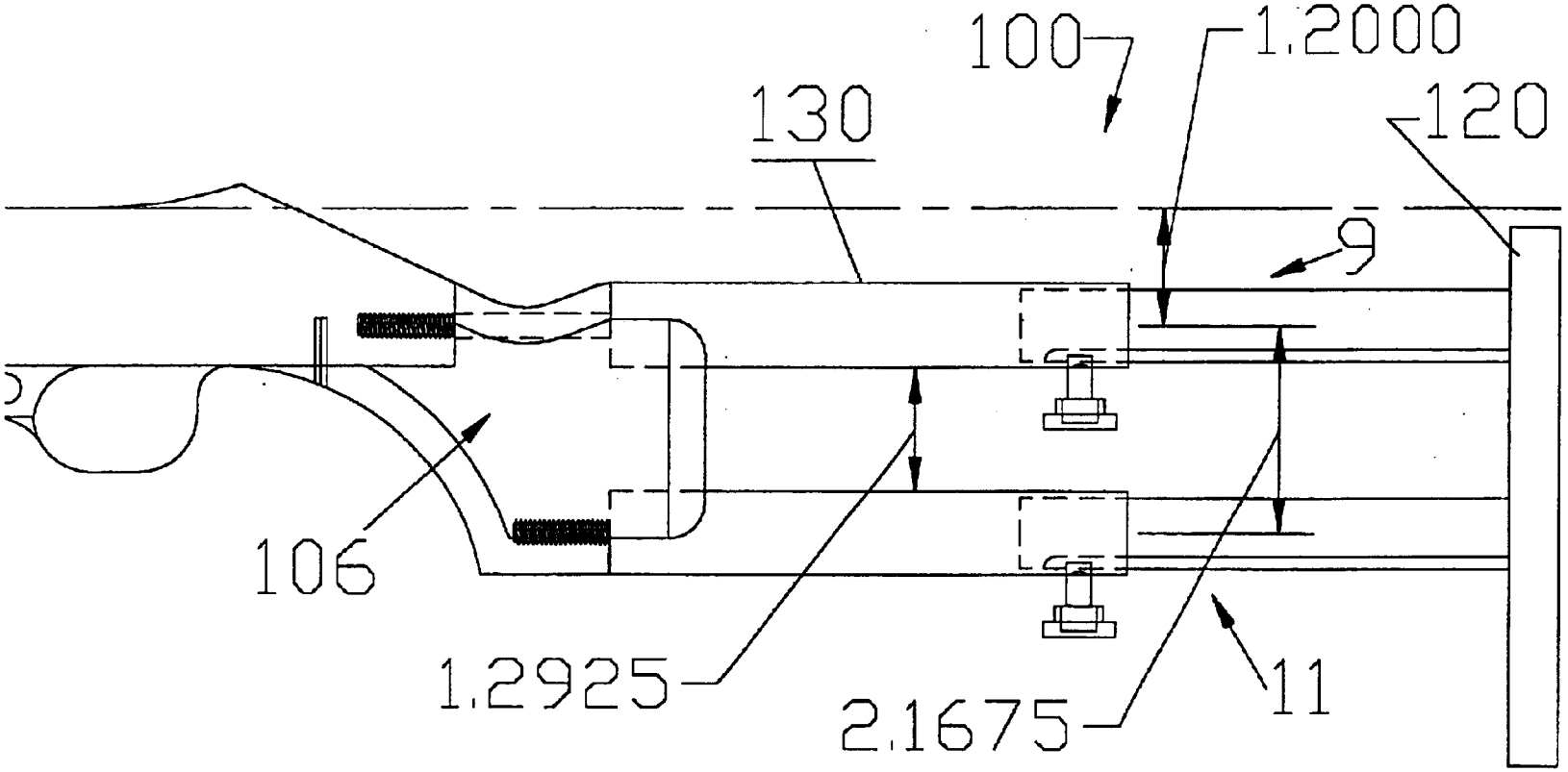
FIG. 8C is a side view of the rear of the weapon of FIGS. 5A–8B, showing preferred spacing of the telescoping connectors.

In FIGS. 1, 2, 5A, 5B, and 6, the extendible shoulder piece is shown connected to a weapon. In FIGS. 7 and 8A and 8B, a particularly-preferred shoulder piece is shown detached from the shortened gun stock of the weapon. The extendible shoulder may be provided as integrally included in a gun stock, or may be provided as a separate unit, such as in FIGS. 7, 8A, and 8B, that may be installed on a shortened gun stock by a gunsmith. The separate unit may installed on a gun stock by screws, bolts, glue and/or other means as may be understood by a gunsmith. The separate unit may consist of, for example, two telescoping, lockable tube systems plus a butt plate, and may be attached to a pre-existing grip portion of a shortened gun stock. Or, the separate unit may consist of, for example, a grip portion, two telescoping, lockable tube systems, and a butt plate, and may be installed on a shortened gun stock without a grip portion.

FIG. 1 shows an embodiment of the extendible shoulder piece installed or provided integrally on a pistol-style grip firearm. In FIG. 1, we can see the extendible shoulder piece 10 extending from the rear of the stock 4. In this embodiment, the grip portion 13 comprises upper region 12 and lower region 6, wherein the lower region takes the form of a pistol-style hand-hold member extending generally downward from the rear end of the stock 4, preferably adjacent to trigger guard 8 extending from the lower surface of the stock 4. The extendible shoulder piece 10 comprises telescoping first tube system 9 and telescoping second tube system 11, with open space 29 in between said tube systems. Locks 22 are shown on both tube systems 9, 11. Also shown in FIG. 1 is bipod 30, the bipod legs of which are adjustable in length. This bipod 30 allows an undersized user to support and stabilize the front end 29 of the weapon.

Figure 2:
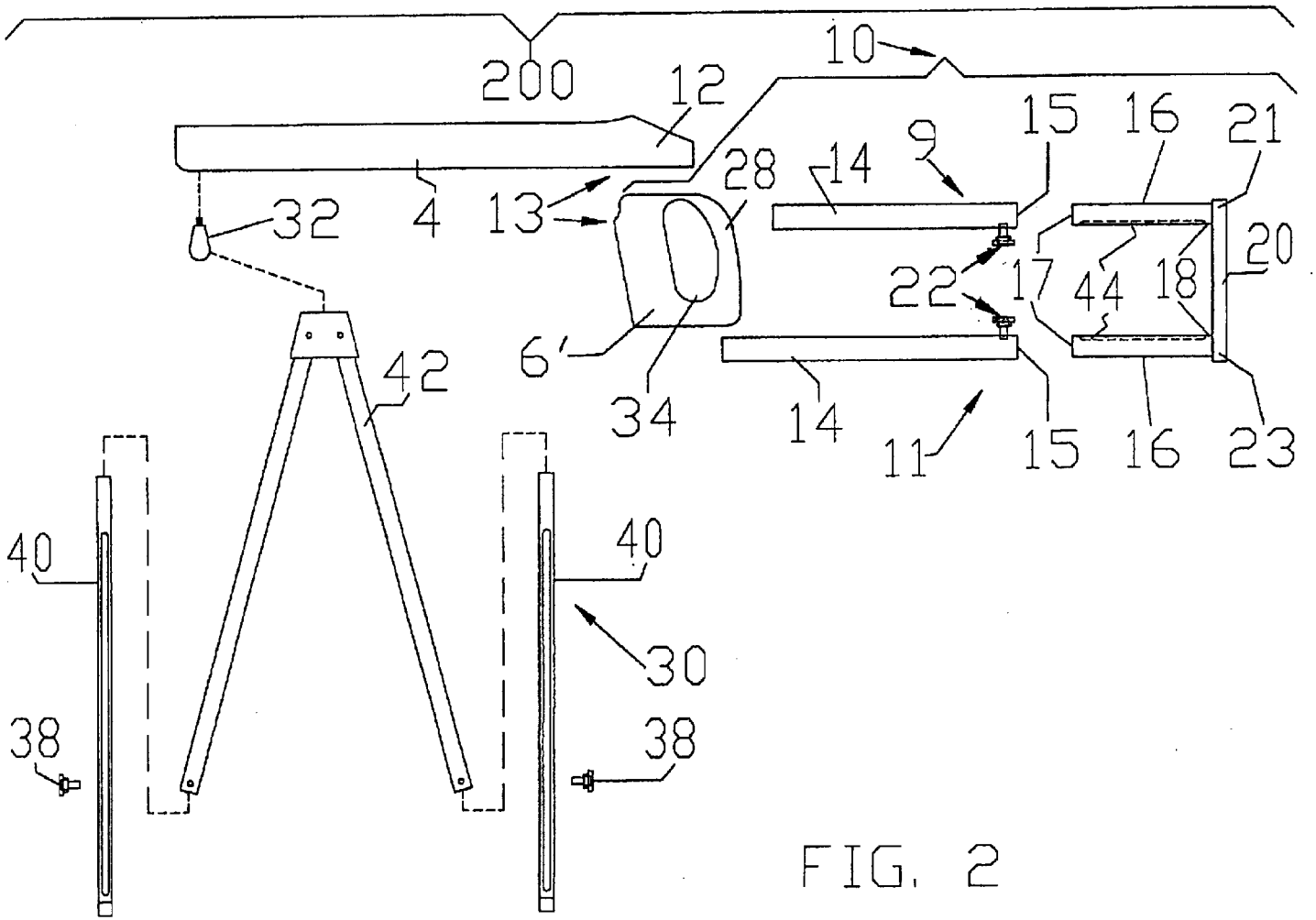
FIG. 2 is an exploded view of the bipod embodiment of FIG. 1, with the extendible shoulder piece also exploded.

Now referring to FIG. 2, an alternative embodiment of a firearm with extendible shoulder piece and bipod 200 is shown in an exploded state. The stock 4 of the gun is a shortened version of a conventional gun stock, wherein the stock has been made short in original manufacture or later shortened by a gunsmith. In this embodiment, the stock's grip portion is formed by the attachment of the hand-hold member 6' to the rear end of the shortened stock, wherein hand-hold member 6' becomes the lower region of the grip portion and the rear end of the stock becomes the upper region 12 of the grip portion 13. In this embodiment, therefore, the lower region of the grip portion is supplied as part of the extendible shoulder piece. The first tube system 9 and second tube system 11 are each made of support tube 14 and a support rod 16 for telescoping cooperation within the support tube 14, preferably by means of the support rod 16 sliding into the support tube 14. The preferred rod 16 and tube 14 are made of steel, but may be made of various materials. The preferred hand-hold 6 is made of plastic but also may be made of various materials.

Locks 22 are preferably included on both first tube system 9 and second tube system 11, rather than being on only one of the tube systems. For alternative adjustable connections, other than a two-tube system, there are preferably as many locks as are needed to make the extendible feature very secure, so no movement/sliding of the shoulder piece takes place during the shock of firing. The locks 22, or other locking means installed on the shoulder piece, allow the user to fix the shoulder piece length into preferably an infinite number of lengths to adjust correctly for different user sizes. Alternatively, the shoulder piece may be made to adjust into many discreet, incremental lengths, but this is less-preferred.

Figure 3:
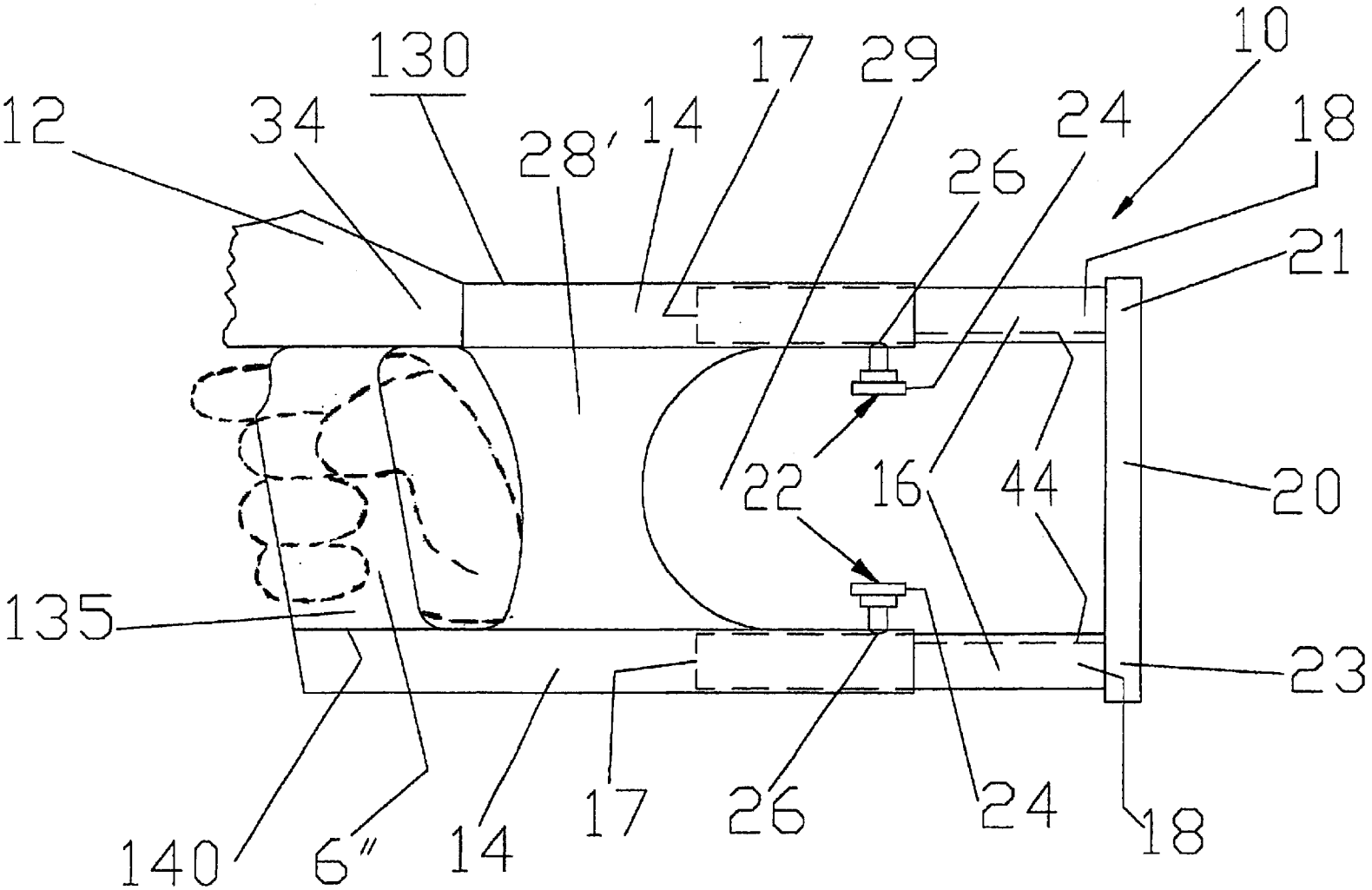
FIG. 3 is a side view of an alternative extendible shoulder piece.

A preferred lock 22 is shown in FIG. 3, and comprises a thumb screw 24 threadably installed in an orifice 26 in the support tube 14, said screw 24 gripping against a groove 44 extending along the length of the support rod 16. Tightening down the screw 24 against the support rod 16 (preferably against groove 44) holds the rod within the tube. Because the groove 44 is preferably continuous and the screw 24 may be tightened down in the groove 44 anywhere along the groove, the adjustability of the telescoping members is continuous. This continuous adjustability provides smooth and continuous, non-incremental adjustment into infinite number of locations between the furthest extremes of adjustability between fully-extended and fully-retracted. This is particularly beneficial for adults working with young, growing users. The groove 44 terminates before the support rod first end 17, to provide a stop against which the thumb screw will abut to keep the rod 16 from accidentally being slid out of the tube 14. Detents (not shown) may further be located along the rod 16 for assisting in precise length measurement from leg to leg. All other attachment means are envisioned as long as each support tube can be fixed and unfixed on its respective support rod. It is envisioned that alternative versions of locking means may be used.

FIG. 3 illustrates an extendible shoulder piece quite similar to that in FIG. 2, except that the rigidizing member behind the thumb hole 34 is an insert 28', rather than being integrally included in the hand-hold 6. In FIG. 3, the pieces-parts are connected together and installed on the gun stock rearward end. The first end 17 of the support rod is inserted into the support tube 14 rearward end 15. The support rod second ends 18 attach to the butt plate 20. Preferably, two support tubes and two support rods are used, oriented in a parallel, horizontal fashion. In such an arrangement, the butt plate has a first end 21 and a second end 23, with a length extending between the first end 21 and the second end 23. The butt plate first end 21 attaches to the first tube system support rod end and the butt plate second end 23 attaches to the second tube system support rod end.

The rear surface of butt plate 20 rests/abuts against the right shoulder of a right-handed operator of the weapon. Thus, this distance from the butt plate to the trigger, can be adjusted by unlocking the locks 22 and sliding the support rods 16 into or out of the support tubes 14 until the proper distance is achieved, then the lock 22 can be locked down, thereby fixedly holding the selected length.

The hand-hold 6' in FIG. 2 (and the similar hand-hold embodiment 6" of FIG. 3) includes thumb hole 34 extending through the shoulder piece. This thumb hole 34 is formed and defined, at least in part, by the upper region 12 and first tube system on its top, the second tube system on its bottom, the hand-hold 6 at its front, and a hand-hold rear-extension 28 or insert 28' at its rear. This thumb hole 34 allows the operator to extend his or her thumb through the hole and grasp the weapon in a one-handed manner more easily, as shown in FIG. 3 in dashed lines. If an insert 28' is used, it is preferably flat and thin, and of such a length to give reasonable accommodation to provide an open space 29 for the use of locking means 22.

Figure 4:
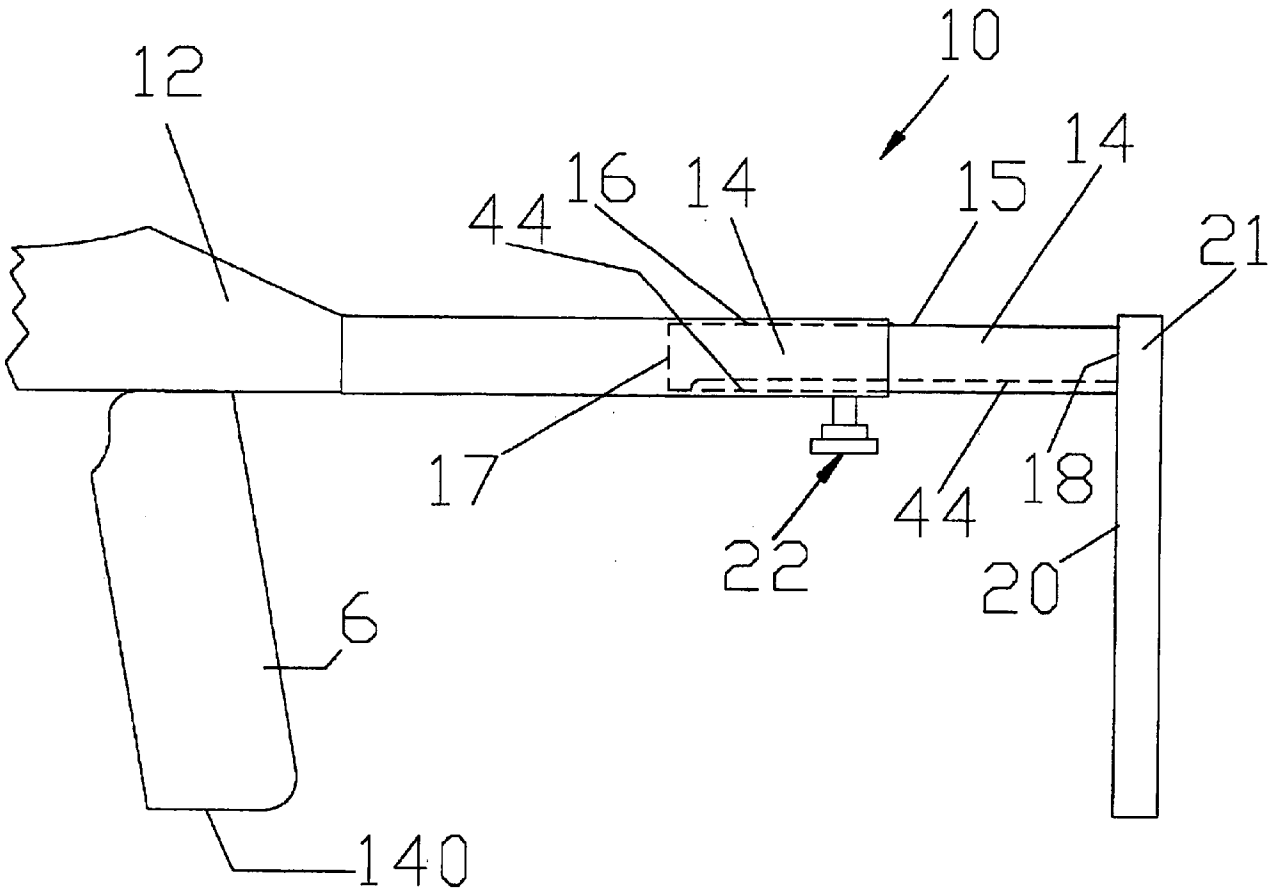
FIG. 4 is a side view of another embodiment of the extendible shoulder piece.

FIG. 4 shows a less-preferred embodiment 10' of an extendible shoulder piece, with a single tube system, that is, a single support tube 14, single rod 16, and single lock 22. The butt plate 20 is shown attached its first end 21 to the support rod second end 18. In this embodiment, the use of lock 22 tightening into groove 44 has the further benefit of keeping the rod (and attached butt plate 20) from rotating.

Figure 5A:
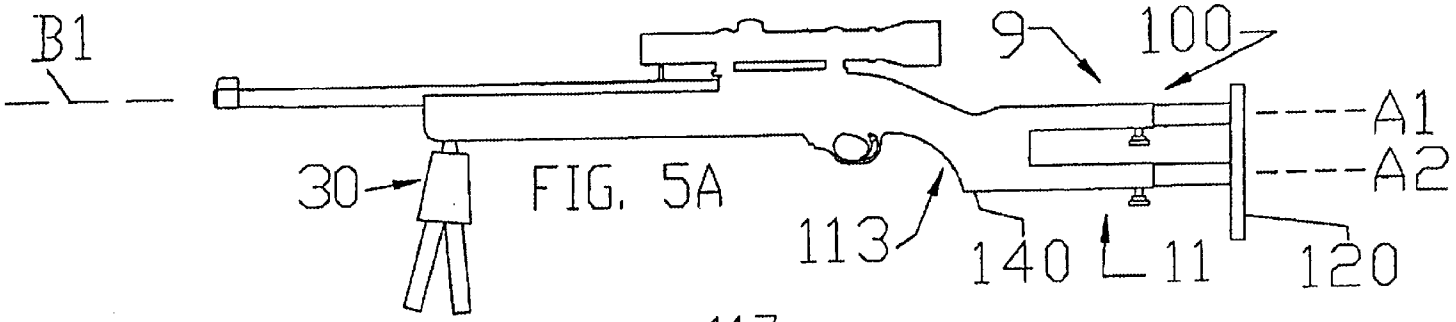
FIG. 5A is a side view of another embodiment of the extendible shoulder piece in an extended position and attached to a non-pistol-grip style weapon.
Figure 5B:
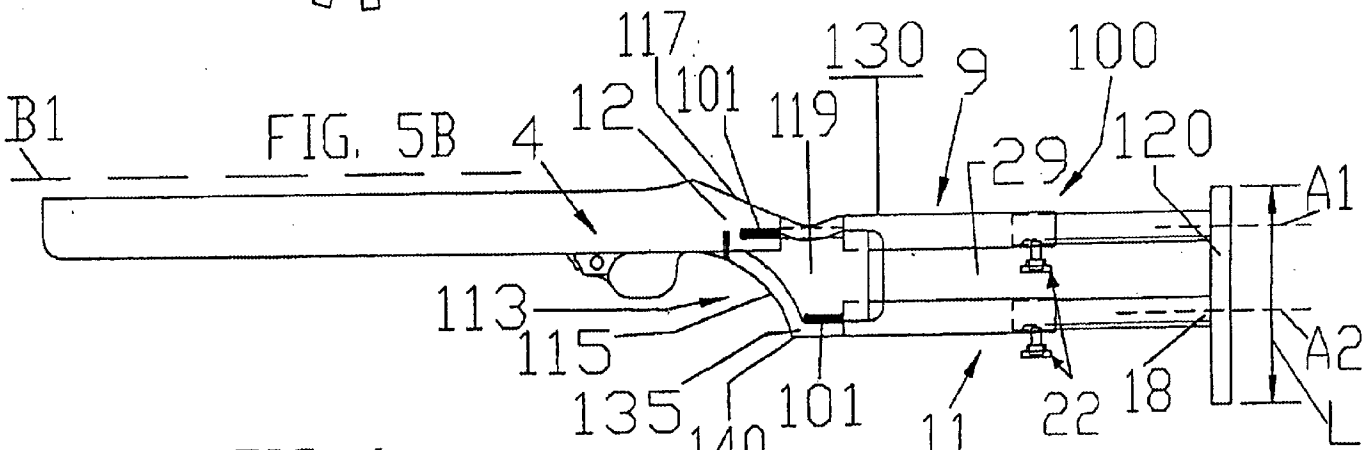
FIG. 5B is a side view of the shoulder piece embodiment in FIG. 5A, with details of attachment shown.
Figure 6:
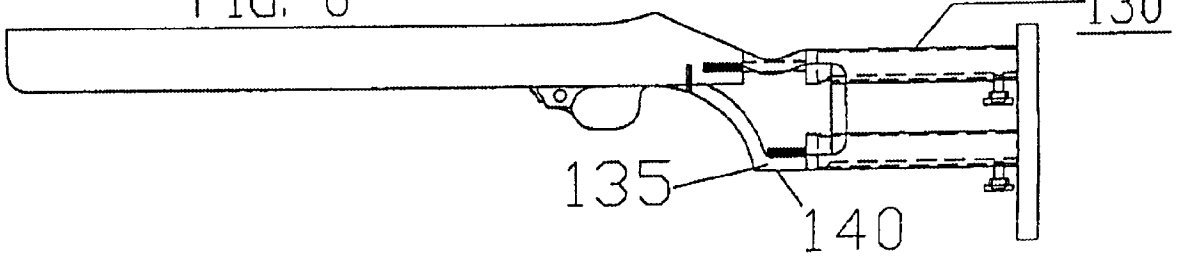
FIG. 6 is a side view of the weapon and extendible shoulder piece of FIGS. 5A and 5B, in a retracted position.

FIGS. 5A, 5B, and 6 illustrate an especially-preferred embodiment of a non-pistol-grip-style weapon with an extendible shoulder piece 100 installed on a shortened gun stock 4. FIGS. 7, 8A and 8B shown the shoulder piece 100 detached from the gun stock 4, suggesting how the hand-hold portion 106 is provided with the tube systems and butt plate, and then installed by a gun smith onto the gun stock. The shoulder piece 100 is preferably bolted onto the shortened stock 4 by means of bolts 101 or other fasteners, glue, or other attachment system. Preferably, one bolt 101 passes from the first tube system 9 through the hand-hold into the gun stock Preferably, another bolt 101 passes from the second tube system into the hand-hold.

In this embodiment, the grip portion 113 gradually curves downward and rearward from the rear end of the shortened stock, wherein the lower curved surface 115 of the grip portion 113 accepts the curled fingers of the user, and the upper curved surface 117 accepts the thumb of the user. The forward area 119 between the first tube system 9 and second tube system 111 may therefore be generally solid as the hand need not extend through that area. Behind area 119, however, open space 29 is still preferred for reaching locks 22. In this embodiment, one may see that the bottom edge of the butt plate 120 extends below the second tube system to increase the length L of the butt plate for stabilization. While the bottom edge may extend, in some embodiments, about 1–2 inches below the lower tube system's rear end, the lower tube system is still considered to be "near" the bottom edge of the butt plate.

Preferably, whether installed on a pistol-style or non-pistol-style grip, the connection of the butt plate to the grip portion is done so that the upper surface 130 of the shoulder piece is slightly below the longitudinal axis of the barrel, so that the user may place his/her cheek on the upper surface 130 and use it as a cheek rest during aiming and shooting. The connection is also preferably designed to extend as far down on the weapon as possible, to maximize the distance from the upper connector to the lower connector. This translates, in most embodiments, to the first tube system being connected to and extending rearward from the rear end of the shortened stock, on an axis A1 that is slightly below the barrel axis B1, wherein axis A1 is also, therefore, slightly below the top horizontal surface of the gun stock. In the embodiment shown in FIGS. 5A–8C, the longitudinal axis of the upper connector is about 1.2 inches lower than the top of the gun stock (see FIG. 8C). Preferably, axis A1 is in the range of about 1.0–1.5 inches lower than the top of the gun stock, as this places, for many weapons, the top surface of the connector at a position distanced from the sights about This translates, in most embodiments, to the second tube system being connected to and extending rearward from the lowermost end 135, that is, the lower extremity, of the grip portion. Thus, the second tube system longitudinal axis A2 is preferably parallel to and on, or nearly on, the same elevation/level as the bottom surface 140 of the grip portion. By "nearly on the same elevation" or "nearly on the same level" is meant that the axis A2 is within about ½ inch of the bottom surface 140, and more preferably, about 7⁄16 inch from the bottom surface 140 (see FIG. 8C). Most preferably, the second tube system has a lower surface that is at the same level as the bottom surface 140. Placing the lower, second tube system 11 as low as possible on the grip portion (rather than extending rearward from midway on the hand-hold 6, or from even higher on the grip portion) serves an important function of maximizing the vertical distance between the preferred two connectors (system 9 and system 11), while still placing the cheek rest surface 130 properly for sighting and/or shooting. A greater distance between the two connectors is easier to achieve in the pistol-grip style, because the hand-hold 6 extends more perpendicularly down from the longitudinal axis of the firearm, and, therefore, the bottom surface of the grip portion is farther down. In the embodiment of FIGS. 5A–8B, the distance between the upper, first tube system 9 and the lower, second tube system 11 is less, but the distance D is still maximized for the particular weapon style, that is, typically about 1½ inches for the embodiment of FIGS. 5A–8C. In such an embodiment, the butt plate 120 is lengthened, as described above, to provide a longer abutment surface for the butt plate against the shoulder.

In use of the preferred shoulder piece, the user holds up the rifle, either through their own power or through assistance of another individual. Then the support rod or rods are slid out of the support tubes the proper distance so the individual will be able to hold the weapon in the proper firing position with hand near the trigger. The proper distance is one which allows the user to operate the weapon and is comfortable for the operator. When this distance is determined, the operator (or his/her assistant) can tighten down the locking means, thereby locking the shoulder piece length.

Pod Support

FIGS. 1, 2, 5A, 9, and 10–16 illustrate embodiments of a bipod according to the invention, for attaching to the forward end of a weapon. The bipod attaches to the underside of the stock 4 so that the bipod 30 extends generally downward from the front half of the gun.

Figure 9:
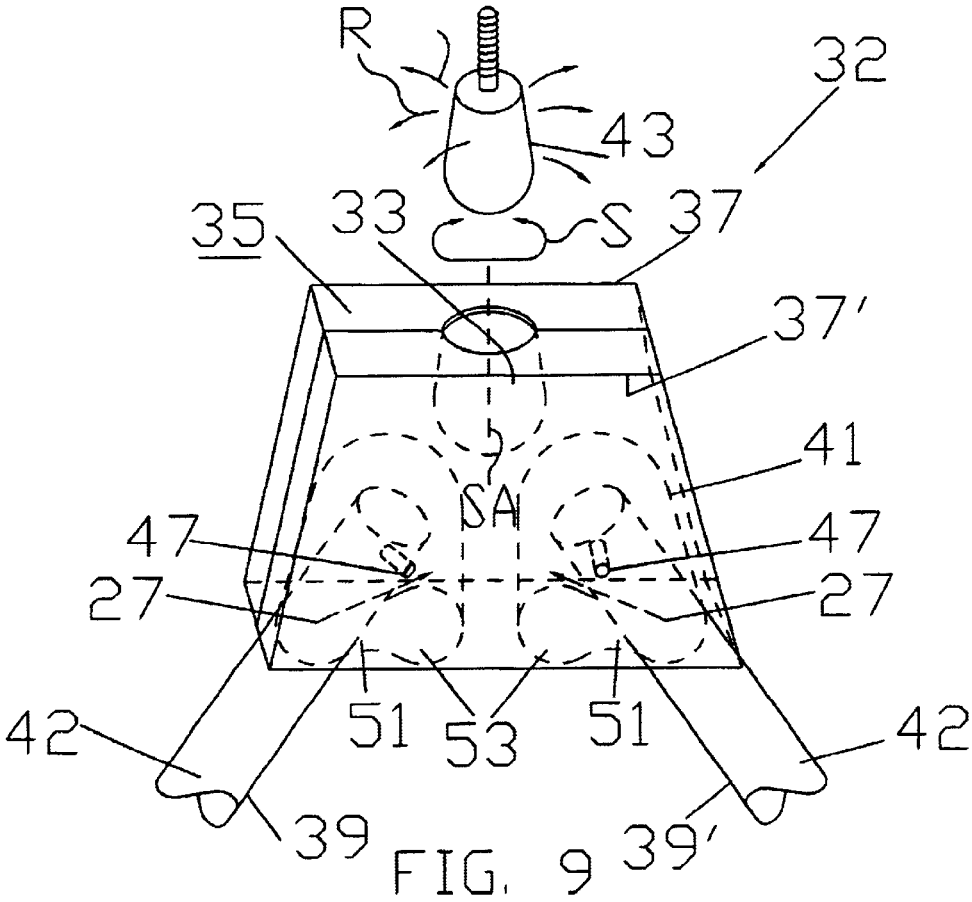
FIG. 9 is a partial perspective view of one embodiment of the invented bipod.

As illustrated in FIGS. 1, 2 and 9, the bipod attachment means 32 may comprise a ball/knob 43 connected to the weapon and generally rotatably received in a mount or bipod main body 41. One embodiment of knob or ball 43, as shown to best advantage in FIG. 9, is attached to the bottom of the weapon by means of a screw or other fastener extending from one side of the knob or ball 43 and extending directly into the stock of the gun. This way, the rounded portion of the knob 43, opposite the screw, extends downward generally perpendicular to the longitudinal axis of the gun stock.

Although single piece bipod bodies are envisioned, the preferred body comprises two symmetrical, mirror image pieces fastened together. The bipod body 41 shown in FIG. 9 is comprised of a pair of separate shells 37, 37' fastened together. The top surface 35 of the mount 41 further comprises a recess called the knob socket 33. The internal surface of the knob socket 33 has a circular opening or entrance of a diameter slightly smaller than the outer diameter (or the outer dimension of the rounded knob portion at its widest point).

The body 41 and the ball 43 are preferably made of a resilient material, such as the preferred materials nylon or UHMW-polyethylene. This allows the knob 43 to be inserted into the socket 33, through the entrance, in a snap-fit fashion. Once the knob 43 is in the socket 33, it can swivel and move inside the socket 33 in multiple directions. This ball and socket joint is releasably attachable and detachable by a user, allowing a user to easily snap the bipod onto and off of the weapon, wherein the ball is permanently or semi-permanently installed on the weapon, and the socket of the bipod is used when desired.

Figure 10:
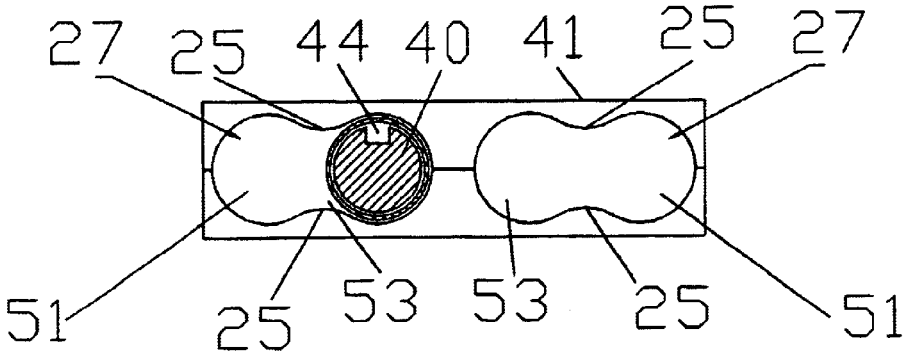
FIG. 10 is a bottom view of the main body of the bipod of FIG. 9, shown with one bipod leg in cross-section in an inward position.

A pair of bipod legs 39, 39' connect to the bottom of the bipod main body 41. The bipod legs 39, 39' attach inside the mount 41 in a pivotal relationship, able to swing on a pivot axis 47, so that each leg can snap between a distanced position (shown in FIG. 9 with the legs in the outer lobes 51) and a closed position when the legs are snapped into the two inner lobes 53 of the leg guide holes 27. FIG. 10 shows the bottom surface 31 of the mount 41, wherein the leg guide holes 27 with outer lobes 51 of the holes 27 and inner lobes 53 of the hole 27. Alternatively, there may be more than two guide holes 27 if there are more than two legs, or each of the guide holes 27 may include more than two lobes, for example, for incremental movement of the legs into various positions. However, the preferred version has two legs and two guide holes with only a fully-opened position (outer lobes 51) and a fully-closed position (lobes 53).

Each of the guide holes 27 in FIGS. 9 and 10 is preferably made from two circular channels or orifices that extend through the bottom surface 31 into the mount 41, wherein the two circular channels (which form lobes 51, 53) that are open to each other and come closer together at their upper ends. Where the adjacent orifices or "lobes" slightly overlap, they form protrusions or "nubs" 25 that protrude into the guide holes 27 to form the resistance to the legs snapping between the lobes 51, 53. The distance between facing nubs 25 is preferably slightly smaller than the outside diameter of the bipod tubes 42. These nubs 25 are formed of a resilient material so that the tubes 42 can by snapped from the inside orifices (lobes 53) to the outside orifices (lobes 51) and, in reverse, from the outside orifices into the inside orifices. The ability of snapping both legs 39, 39' into the inside position (the tubes 42 in the inside orifices of "lobes" 53) allows for compact storage of the bipod with the legs together and quick set-up for use of the bipod by simply snapping the two legs apart. Preferably, no other adjustment or set-up of the legs is needed to spread the legs apart, and especially no screw, bolt, or fastener adjustment is needed to secure the legs in their desired inward or outward positions. As described below, a set-screw-style telescoping or other lengthening or shortening system may be used to adjust the length of the legs, but this is preferably independent from the system that sets the legs at an angle to each other. The snap-apart feature adapts each leg to be in either of two locations, either in an inward position or an outward position. With both legs pulled apart, the distance between the two legs is an appropriate amount for stable and safe use. With both legs pushed inward, the distance between the two legs is minimal or none, and the bipod is compact for storage and travel.

The ball/socket joint between the knob or ball 43 and the bipod body 41 serves to attach the bipod 30 to the stock 4 and allows the weapon 2 to be swiveled generally horizontally on the bore axis of the socket 33 (movement represented by arrow S on "socket axis" SA in FIG. 9), by means of the gun with its attached ball 43 being swiveled relative to the bipod body, and, hence, swiveled relative to the stationary legs. Also, this connection may allow several degrees of angle adjustment to the level of the barrel, by means of the ball 43 rotating or "rolling" to some extent inside the socket 33. This "rolling" motion is represented as the "R" arrows in FIG. 9. Throughout the swiveling and rolling motions, which give the user a wide range of possible positions for the barrel of the gun, the shooter leaves the bipod leg feet fixed on the ground and tilts the gun forward or backward in any vertical plane and/or pans side to side in a range of about, for example, up to about 20 degrees up from horizontal or down to about 20 degrees down from horizontal.

The bipod 30 is able to be adjusted for height so that users of different height can use the bipod, or for use in a standing, seated, or prone position. The bipod legs may be adjustable in length, for example, as shown in FIG. 2. In each leg of FIG. 2, bipod rod 40 telescopingly engages a bipod tube 42. A thumb screw 38 is inserted through a lock hole in the bipod tube 42 and cooperates with a slot running the length of the rod 40 to lock the bipod rod 40 within the bipod tube 42 at selectable heights. Other adjustment/locking means are also envisioned.

Therefore, because of the movement of the ball 43 relative to the body 41 and the adjustability of the leg length, bipod 30 has two methods of height adjustment. First, rough adjustment is preferably done by means of adjusting the length of the legs, for example, by set screws, pins, or other leg length adjustment. Second, fine adjustment is preferably done by raising or lowering the barrel by means of the ball-joint-type connection between the ball 43 on the gun and the bipod body 41, for example, rocking and tilting action forward or backward, side to side, with the feet of the bipod resting on the ground and not moving relative to the bipod body 41.

FIGS. 11–16 illustrate an especially-preferred embodiment of the bipod 130. Bipod 130 include two legs that may be made, for example, like those illustrated in FIGS. 1, 2, and 9. The bipod main body 141 is preferably made from two mirror image halves 137, 137', that are fastened together by nuts and bolts 160 or other fasteners that clamp the halves 137, 137' together to provide pressure on the bipod legs. Further, the bolts (at 161) provide pivot axles for the legs inside the main body.

Figure 11:
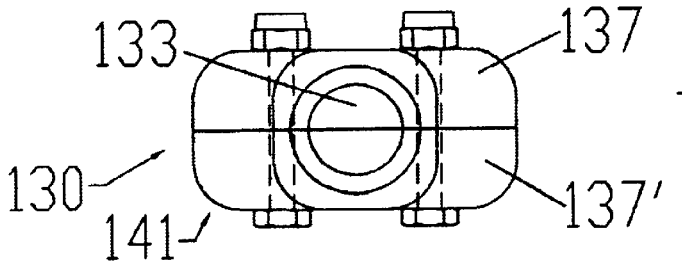
FIG. 11 is a top view of another preferred embodiment of the invented bipod.
Figure 12:
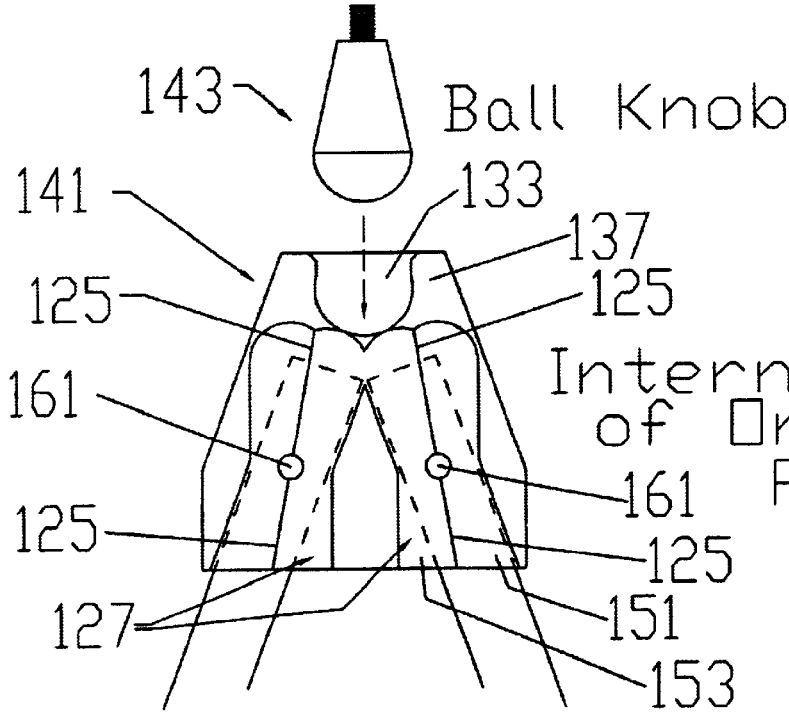
FIG. 12 is a side partial view of the bipod of FIG. 11, showing the internal surfaces of one half of the main body of the bipod, showing legs in dashed lines and showing the knob/ball removed from the main body socket.
Figure 13:
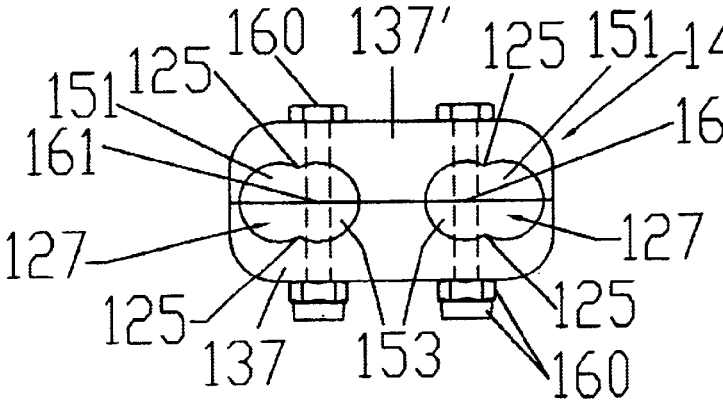
FIG. 13 is a bottom view of the bipod of FIGS. 11 and 12, without the legs.

FIG. 11 shows a top view of the main body 141 of the bipod 140, including the socket 133 and the two halves 137, 137'. FIG. 12 illustrates a side view of the one of the halves 137 of the main body 141 and the ball knob 143. Especially-preferred guide holes 127 extend substantially all the way into the main body, with the bolts (161) being generally centrally located in the guide holes to act as axles. The top ends of the legs extend up into the guide holes to near the top end of the holes, and, due to the shape of the guide holes, the legs may snap in and out, pivoting on the axles. One may see that the extreme top ends of the legs move inward toward each other in the guide holes when the lower ends of the legs move outward away from each other. The extreme top ends of the legs will move outward from each other in the top ends of the guide holes when the lower ends of the legs move inward toward each other.

The guide holes may be made by various methods, for example, by a ball cutter by cutting a 180 degree depth into each half 137, 137', leaving ridges in between, which ridges are the nubs 125 between the elongated inner lobes 153 and the outer lobes 151. The ridges (nubs 125) in this preferred design extend all the way along the length of the guide holes from the openings of the holes to the top of the holes. Thus, the increased length of the ridges, relative to the nubs 25 in the embodiment of FIG. 9, provides a greater resistance to unwanted movement of the s relative to the main body, until the user wishes to purposely move the legs for set-up or storage.

Further, various methods of forming the socket 33, 133 may be used, such as molding or cutting with a ball cutter. The ball cutter may be used to cut 180 degree depth in each half at the top of the main body halves.

Figure 14:
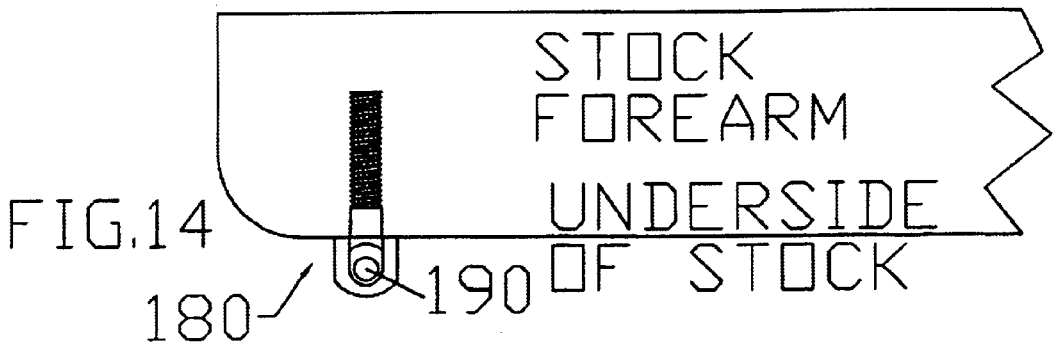
FIG. 14 is a side view of a conventional swivel attached to a firearm stock, such as may be used with the invented bipod.
Figure 15B:
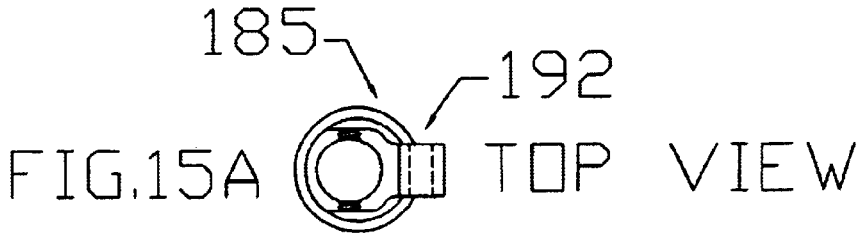
FIG. 15B is a side view of the adaptor of FIG. 15A.
Figure 15B:
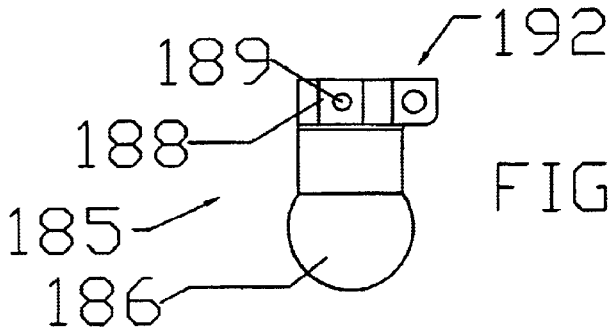
Figure 16:
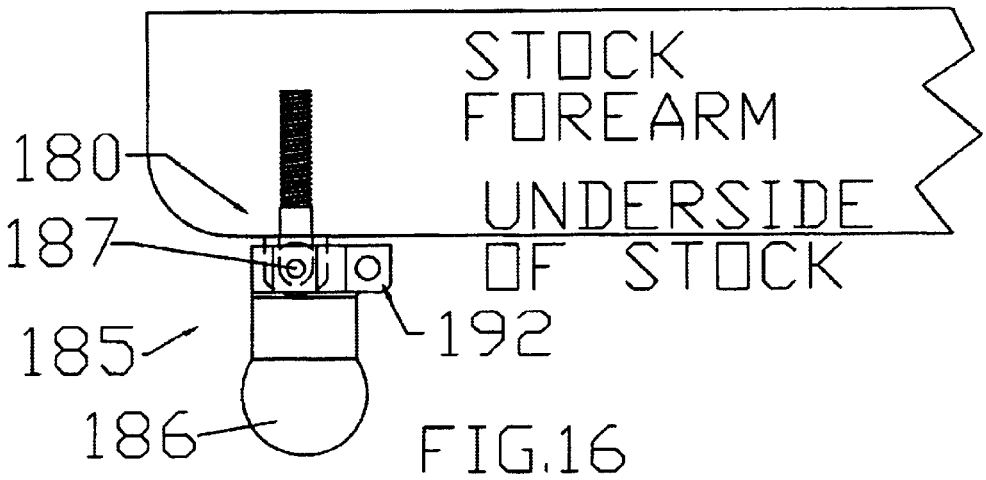
FIG. 16 is a side view of the adaptor of FIGS. 15A and B, attached to the swivel of FIG. 14.

FIGS. 14–16 illustrate an alternative system for connecting embodiments of the invented bipod to a firearm/weapon. Instead of removing a conventional, existing sling swivel stud from a firearm, the conventional swivel stud 180 may remain on the front of the firearm. Rather than attaching the sling (not shown) to the swivel stud 180 directly, an adaptor 185 is provided that fits over and attaches to the conventional swivel stud 180. Adaptor 185 includes a ball/knob rounded end 186 and a fastener end 188. The fastener end 188 includes a top cavity for receiving the swivel stud 180 and holes 189 through the fastener end 188 for receiving a threaded screw/bolt 187 to anchor the adaptor 185 to the swivel stud. The threaded screw/bolt extends through the adaptor holes 189 and through the swivel stud hole 190 to provide a secure attachment.

When the adaptor 185 is in place over the swivel stud, the ball/knob end 186 extends downward for being snapped into the socket 33 of the main body of the bipod. The fastener end 188 also preferably includes an extension 192 extending outward to the side of the adaptor, and a conventional sling may be connected to the extension 192 rather than to the conventional swivel stud. This way, use of the bipod does not interfere with use of the sling, and the conventional swivel stud does not need to be removed and another ball/knob screw member does not need to be screwed into the wood of the forestock. FIG. 16 shows to best advantage the adaptor 185 installed on the stock forearm, ready to have the ball/knob snapped into the socket of the bipod.

While the preferred embodiment includes a ball/knob attached to the firearm and the bipod having a receiving socket, the reverse could be practiced in some embodiments. The bipod could include a ball/knob and an adaptor on the firearm could include a socket.

When the invented bipod is being used to help as part of a training system for an adult teaching an adolescent, the adult can take the weapon, set the proper distance between the adolescent's shoulder and the butt plate, lock down the locking means, attach the gun to the bipod, and adjust the bipod to the appropriate height. Then the adult merely has to supervise the adolescent as the weapon is fired. Without use of such a bipod, in order for adolescents to learn how to shoot, either the adult will be required to hold up the forward end of the gun (which the adolescent does not have the arm length or strength to support), or the adolescent is required to lay prone with the forward end of the gun resting upon an object.

Because most children are not of a size and strength sufficient to handle the average weight of a typical rifle, a right-handed child would also be able to grasp the bottom support tube member with their left hand and thereby steady the gun located on the bipod. Such a right-handed user would then place their hand on and around the hand-hold member with their finger at or near the trigger. This is especially helpful when the user does not have arm length sufficient to reach the forward portion of the stock for support of the stock. This format would also work well for left-handed shooters using their opposite hands in a likewise manner.

In some embodiments, it is preferred that the bipod only allow minimal movement within the horizontal plane of the rifle or weapon, which may be provided by adapting the shape of the ball/knob and socket or by putting stops on the system that limit horizontal movement. This would keep an inexperienced user from swinging the firing end of the weapon around in the direction of others. This would allow an adult supervisor to set the rifle down pointed in a proper direction, and have some confidence that the child using the gun will not be likely to turn the gun to be facing other individuals.

The easy adjustability of the extendible shoulder piece allows an adult or other individual to change the gun butt distance quickly and easily, thereby allowing multiple individuals to use the same gun.

The extendible shoulder piece may be sold either as a replacement stock incorporating the improved shoulder piece, or may be sold as a stand alone kit for attachment to a weapon by a handy operator.

The preferred shooting system including the extendible shoulder piece includes the steps of taking a firearm having such an improved gun stock and adjusting the gun stock to the proper pull length (length of pull from trigger guard to stock butt). Once the proper pull length is determined and set, the firearm can be set upon the bipod. The bipod is then adjusted to the proper height for the person using the weapon and his/her position. The person is then able to use the weapon with the bipod supporting the front of the weapon and the adjustable shoulder piece allowing the user to more comfortably and properly the gun having proper trigger pull distance.

While the preferred version of the bipod is especially effective for a firearm, other uses are envisioned. For example, features of the bipod may be effective when used in photography, telescopes and other optical equipment. While the preferred pod is a bipod, other numbers of legs may be used, and the main body of the pod may be changed in shape and size to accommodate more than two legs and more than two guide holes. Therefore, the use of the term "equipment" in the claims, is not necessarily just a firearm, but may be other items and instruments, scientific, optical, or others.

Although this invention has been described above with reference to particular means, materials and embodiments, it is to be understood that the invention is not limited to these disclosed particulars, but extends instead to all equivalents within the scope of the following claims.

I claim:

1. A pod support for a piece of equipment such as a weapon, the pod support comprising:

a plurality of legs;

a main body with an interior and having a guide hole extending into the interior for each of said legs, said guide hole being defined by a guide hole wall, wherein each guide hole comprises a plurality of hole lobes separated by a protrusion extending from the guide hole wall into the guide hole;

wherein a leg is received in each of said guide holes and is movable relative to the main body between said plurality of lobes past said protrusion, wherein the protrusion restricts movement so that the leg snaps between the lobes of its guide hole and is held in a lobe until forced by the user to snap past said protrusion; and an attachment system for mounting the pod support to said piece of equipment, said attachment system comprising a knob adapted to be fixed to said piece equipment and a socket extending into a top surface of the main body and rotatably receiving the knob so that the knob rotates in said socket to move said piece of equipment relative to the main body of the pod support.

2. A pod support for a piece of equipment such as a weapon or a camera, the pod support comprising:

right and left legs;

a main body having a bottom surface, top surface, right and left side surfaces, a central interior region, and right and left guide holes extending generally upward into the main body from the bottom surface and receiving the right and left legs, respectively;

wherein:

said right guide hole has an outer hole portion near the right side surface and an inner hole portion near the central interior region, and said left guide hole has an outer hole portion near the left side surface and an inner hole portion near the central interior region;

the right and left legs pivot toward each other to a storage position by moving into the inner hole portions of their respective guide holes, so that the legs are generally parallel and close to each other;

the right and left legs pivot away from each other to a set-up position by moving into the outer hole portions of their respective guide holes, so that lower ends of the legs are distanced from each other for supporting said piece of equipment;

said main body comprises a right protrusion extending into the right guide hole between the inner and outer hole portions of the right guide hole, the right protrusion being adapted to resist movement of the right leg between said inner and outer hole portions of the right guide hole; and said main body comprises a left protrusion extending into the left guide hole between the inner and outer hole portions of the left guide hole, the left protrusion being adapted to resist movement of the left leg between said inner and outer hole portions of the left guide hole;

so that the right and left legs are retained in the set-up position until snapped past said right and left protrusion into the storage position.

3. A pod support as in claim 2, wherein said right protrusion and said left protrusion are made of resilient material.

4. A pod support as in claim 2, further comprising knob adapted to be fixed to said piece of equipment, and said main body comprises a socket extending into a top surface of the main body, the socket rotatably receiving the knob so that the knob moves in said socket so that said piece of equipment is movable relative to the main body of the pod support.

5. The pod support as in claim 4 comprising only one ball joint connection and wherein said one ball joint connection is said knob being rotatably received in the socket.

6. The pod support as in claim 4, having only two legs and two guide holes which are said right and left legs and said right and left guide holes.

7. The pod support as in claim 4, wherein the knob has a diameter and the socket has a restricted opening having a diameter smaller than the knob diameter, so that knob snaps into the socket past surfaces of the smaller diameter opening.

8. A pod support comprising:

a plurality of legs;

a main body having a top surface, a bottom surface, and a central axis between the top surface and bottom surface, the main body further having a plurality of guide holes each having an axial dimension generally parallel to the central axis, each guide hole receiving one of said legs so that the leg is generally parallel to said axial dimension, each guide hole further having an inner hole portion extending transversely to the axial dimension toward said central axis and having an outer hole portion extending transversely to the axial dimension away from said central axis;

wherein each leg is pivotal in its respective guide hole between the inner hole portion and the outer hole portion so that, when in the inner hole portions, the legs are generally parallel and close together in a collapsed position, and, when in the outer hole portions, the legs are spread apart in a support position for supporting an object;

wherein a protrusion extends into each guide hole between the inner hole portion and the outer hole portion and is adapted to resist the leg received in the guide hole from moving between said inner hole portion and said outer hole portion until a user forces each leg past the protrusions in their respective holes.

9. A pod support as in claim 8, wherein said main body is made of a resilient material.

10. A pod support as in claim 9, wherein said legs are extendable or adjusting length of the legs.

11. A pod support as in claim 8, wherein said main body comprises two portions and a plurality of fasteners connecting said two portions together, wherein the fasteners extend through the main body and are adapted to hold the legs in the guide holes so that the legs pivot on the fasteners.

12. A pod support as in claim 8, further comprising an adaptor that is attachable to a swivel stud on the firearm, and the adaptor having a ball on one end which is said knob and a bore on an opposite end that receives said swivel stud.

13. A pod support as in claim 12, wherein said adaptor further comprises an extension adapted to hold a firearm sling.

14. A pod support as in claim 8, wherein said protrusion into each guide hole is made of resilient material so the leg snaps past the protrusion.

15. A pod support as in claim 8, further comprising:

a connection system for connecting the main body to a firearm, the connecting system comprising a socket in a top surface of the main body, and a single knob adapted to be fixed to a firearm, the single knob snapping into, and being movably received in the socket so that the single knob is swivelable in the socket to swivel the firearm relative to the main body in a generally horizontal plane generally parallel to the top surface of the main body, and the single knob being rotatable in the socket so that the firearm may be tilted up and down relative to the main body in a plurality vertical planes.

* * * * *